United States Patent [19]

Haas et al.

[11] Patent Number: 5,046,635

[45] Date of Patent: Sep. 10, 1991

[54] TRASH SEPARATOR CONTAINER

[76] Inventors: Karen Haas; Stephen P. Cielatka, both of P.O. Box 759, Mattituck, N.Y. 11952

[21] Appl. No.: 666,373

[22] Filed: Mar. 8, 1991

[51] Int. Cl.[5] ..... B65D 1/24

[52] U.S. Cl. ..... 220/524; 220/408; 220/628; 220/909

[58] Field of Search ..... 220/524, 628, 629, 636, 220/908, 909, 408

[56] References Cited

U.S. PATENT DOCUMENTS

| | | | |
|---|---|---|---|
| 2,667,360 | 1/1954 | Leystra | 220/628 X |
| 4,878,592 | 11/1989 | Lee | 220/408 X |
| 4,905,853 | 3/1990 | Strawder | 220/404 X |
| 4,960,220 | 10/1990 | Foa | 220/909 X |

*Primary Examiner*—Steven M. Pollard

*Attorney, Agent, or Firm*—Michael I. Kroll

[57] ABSTRACT

An improved trash separator container is provided and consists of a housing having a closed bottom wall and an open top. A first mechanism is within the housing, for dividing the housing into multiple compartments to separately store different types of trash items which are to be recycled therefrom. A top cover fits over the open top of the housing. A second mechanism is in said top cover, for gaining access into each of the compartments so as to deposit the different types of trash items into the compartments. A third mechanism is connected to the closed bottom wall of the housing, for rotating the housing latitudinally along its axis when placed upon a flat surface so that one portion of the access mechanism will always face a person, allowing the person to deposit the trash items into one of the selective compartments.

12 Claims, 2 Drawing Sheets

Fig. 1
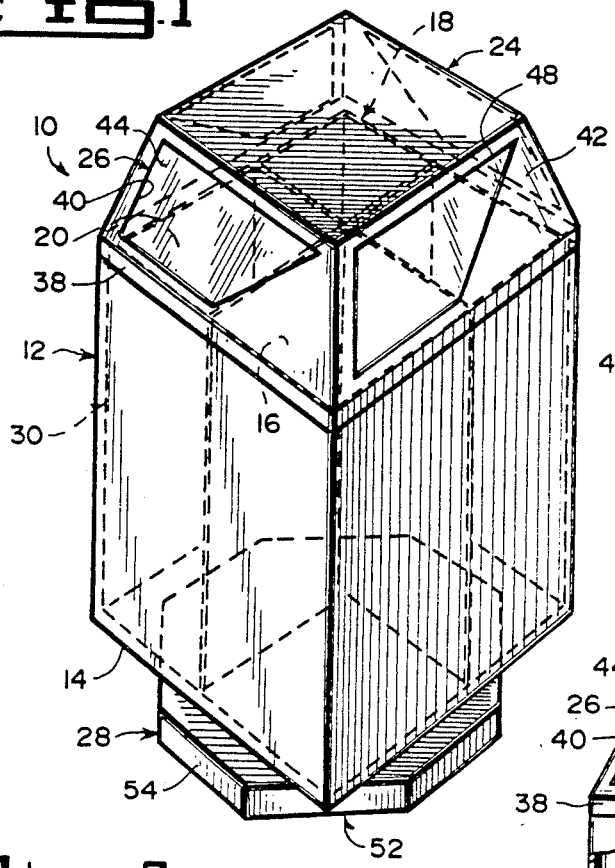
Fig. 2
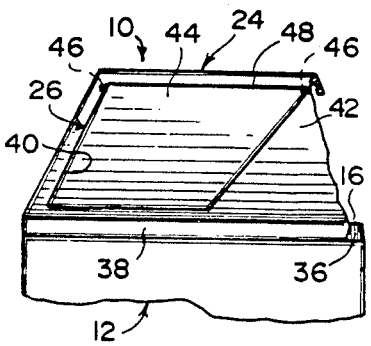
Fig. 3
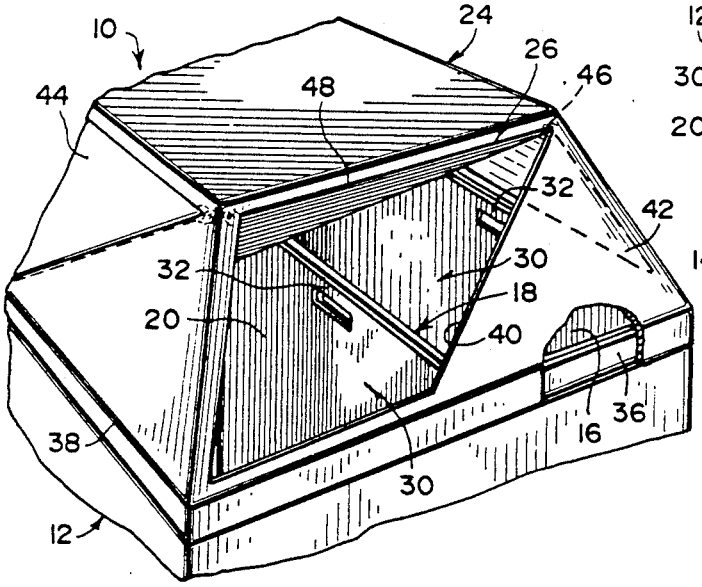
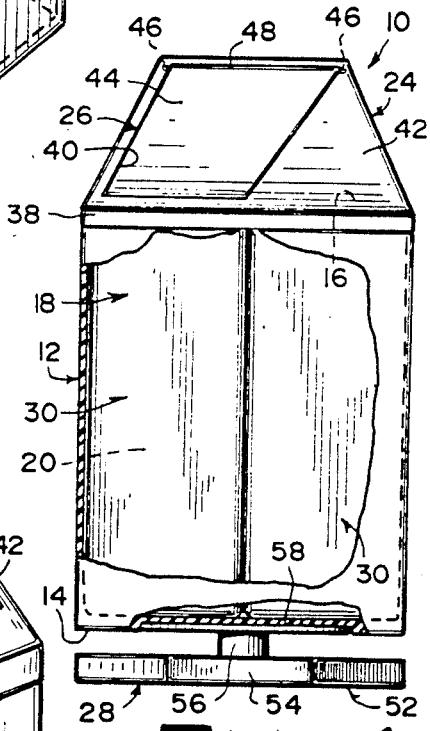
Fig. 4

TRASH SEPARATOR CONTAINER

BACKGROUND OF THE INVENTION

1. Field of the Invention

The instant invention relates generally to garbage disposal devices and more specifically it relates to an improved trash separator container.

2. Description of the Prior Art

Numerous garbage disposal devices have been provided in prior art that are adapted to get rid of the garbage in various ways. While these units may be suitable for the particular purpose to which they address, they would not be as suitable for the purposes of the present invention as heretofore described.

SUMMARY OF THE INVENTION

A primary object of the present invention is to provide an improved trash separator container that will overcome the shortcomings of the prior art devices.

Another object is to provide an improved trash separator container that includes multiple compartments which will separate trash into different items to be recycled.

An additional object is to provide an improved trash separator container that includes a top cover which fits over a rotatable housing so that a single access into the housing for each compartment can be accomplished in each side of the top cover through a hinged door on each side.

A further object is to provide an improved trash separator container that is simple and easy to use.

A still further object is to provide an improved trash separator container that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a perspective view of the instant invention.

FIG. 2 is an elevational view of the upper portion of the invention with parts broken away.

FIG. 3 is a perspective view of the upper portion of the invention with parts broken away and one of the doors open.

FIG. 4 is an elevational view of the invention with parts broken away.

DETAILED DESCRIPTION OF THE PREFERRED EMBODIMENTS

Figure 5:
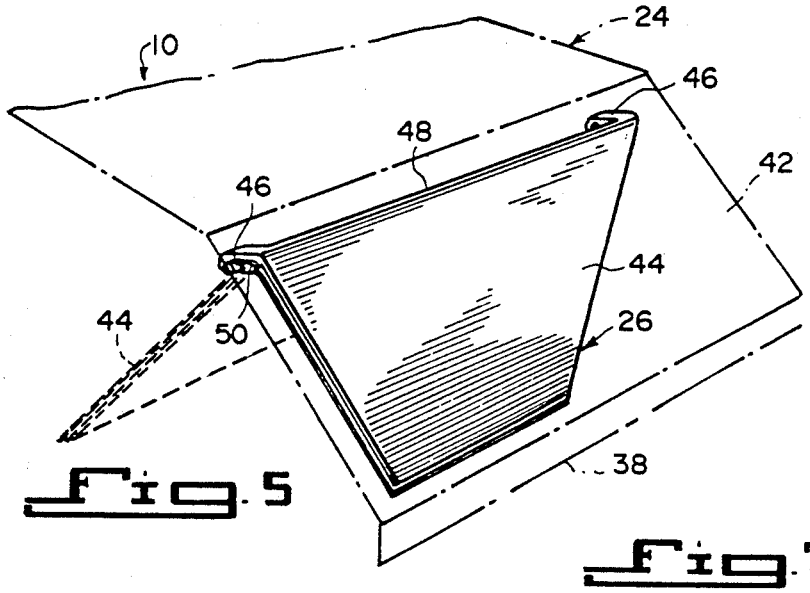
FIG. 5 is a perspective view of one of the doors with part of the top cover shown in phantom.
Figure 6:
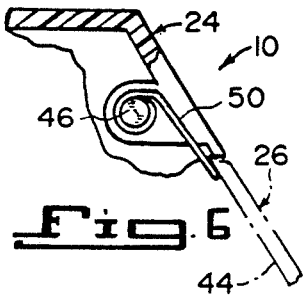
FIG. 6 is a detail view showing the door retainer spring in the top cover.
Figure 7:
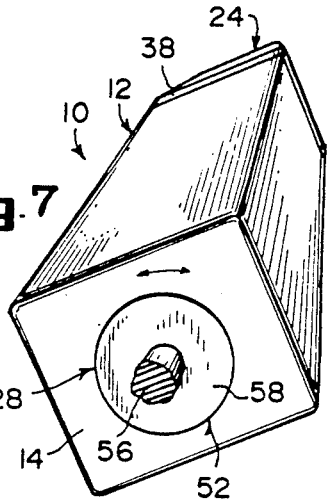
FIG. 7 is a bottom perspective view with the base of the lazy susan removed.
Figure 8:
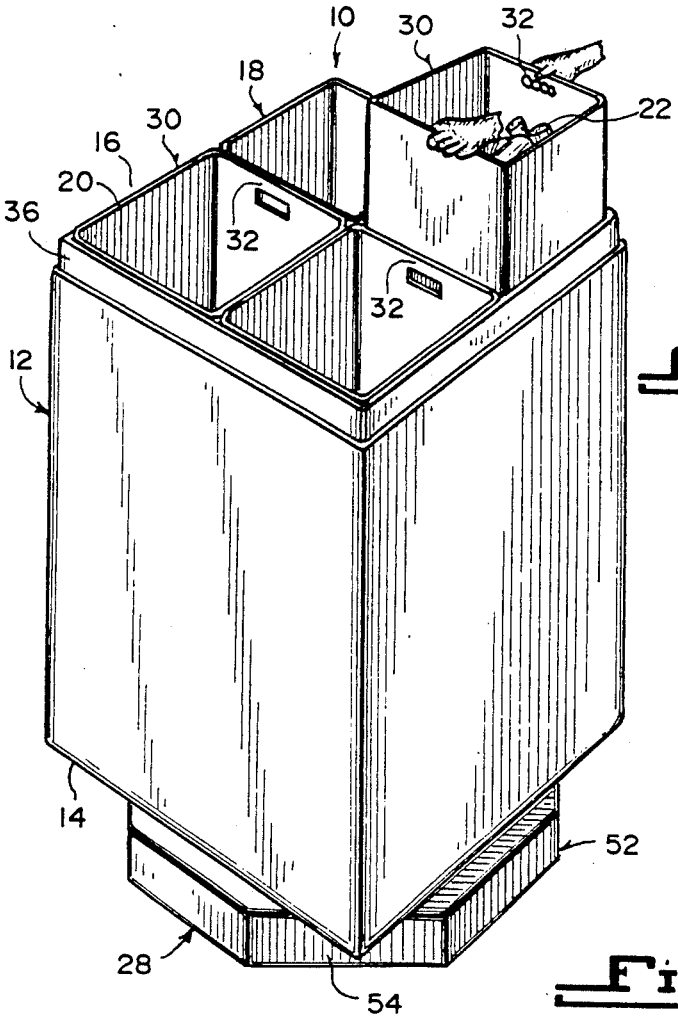
FIG. 8 is a perspective view with the top cover removed and one of the inner receptacles being removed therefrom.

Turning now descriptively to the drawings, in which similar reference characters denote similar elements throughout the several views, the Figures illustrate an improved trash separator container 10 which consists of a housing 12 having a closed bottom wall 14 and an open top 16. A first mechanism 18 is within the housing 12, for dividing the housing into multiple compartments 20 to separately store different types of trash items 22 which are to be recycled therefrom. A top cover 24 fits over the open top 16 of the housing 12. A second mechanism 26 is in the top cover 24, for gaining access into each of the compartments 20 so as to deposit the different types of trash items 22 into the compartments 20. A third mechanism 28 is connected to the bottom wall 14 of the housing 12 for rotating the housing 12 latitudinally along its axis when placed upon a flat surface so that one portion of the second mechanism will always face a person, allowing the person to deposit the trash items 22 into on of the selective compartments 20.

The first mechanism 18 includes a plurality of receptacles 30, each having an open top 32 with each receptacle 30 sized to fit into the housing 12. Each receptacle 30 includes a pair of hand grips 34 so that said receptacles 30 can be installed and removed from the housing 12 by the person.

The housing 12 has a recessed upwardly extending flange 36 about the open top 16 thereof, while the top cover 24 has a downwardly extending lip 38 about its perimeter so that the lip 38 can fit over the flange 36 of the housing 12.

The second mechanism 26 includes the top cover 24 having an aperture 40 formed in each side 42 thereof and a plurality of doors 44. Each door 44 is hinged at 46 along its top edge 48 to an aperture 40 in the top cover 24 so that each door 44 must be pushed inwardly to gain access to one of the receptacles 30. Each door 44 includes a spring 50 at the hinge 46 so that the door 44 will normally be in a closed position.

The third mechanism 28 is a lazy susan configuration 52 that includes a base member 54 to sit upon the flat surface, a stanchion 56 extending upwardly from the center of the base member 54 and a plate 58 rotatable upon the stanchion 56 and is affixed to the bottom wall 14 of the housing 12.

In FIGS. 1 through 8, the housing 12 is in a four sided box-shaped configuration so that four receptacles 30 can fit therein. The top cover 24 is in the shape of a four sided frustrum pyramid, each door 44 is in the shape of a trapezoid so that when opened will expose only one of the receptacles 30 therein and the base member 54 is in the shape of an octagonal plinth.

Figure 9:
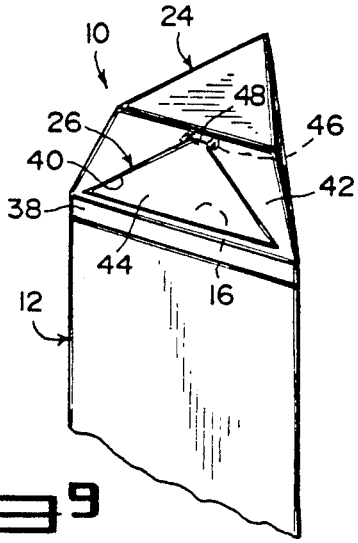
FIG. 9 is a perspective view showing the upper portion of a modification.

In FIG. 9, the housing 12 is in a three sided triangular shaped configuration so that three receptacles 30 can fit therein, the top cover 24 is in the shape of a three sided frustrum pyramid, while each door 44 is in the shape of a frustrum triangle so that when opened will expose only one of the receptacles 30 therein.

To use the improved trash separator container 10, a person simply places the base member 54 upon the flat surface. Each receptacle 30 is then placed into the housing 12, with the top cover 24 then put thereon. When the trash items 22 are to be deposited into the receptacles 30, the housing 12 is rotated to the proper door 44. When the receptacles 30 are completely filled up, the top cover 24 is then removed and each receptacle 30 taken out by the hand grips 34 so that the trash items 22 can be recycled.

LIST OF REFERENCE NUMBERS

10: improved trash separator container
12: housing
14: closed bottom wall in 12
16: open top in 12
18: first mechanism
20: compartment
22: trash items
24: top cover
26: second mechanism
28: third mechanism
30: receptacle
32: open top in 30
34: hand grip in 30
36: recessed upwardly extending flange on 12
38: downwardly extending lip on 24
40: aperture in 24
42: side of 24
44: door
46: hinge
48: top edge of 44
50: spring
52: lazy susan configuration
54: base member
56: stanchion
58: plate It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An improved trash separator container which comprises:

a) a housing having a closed bottom wall and an open top;

b) means within said housing for dividing said housing into multiple compartments to separately store different types of trash items which ar to be recycled therefrom;

c) a top cover to fit over the open top of said housing;

d) means in said top cover, for gaining access into each of the compartments so as to deposit the different types of trash items into the compartments, wherein said means for gaining access includes said top cover having an aperture formed in each side thereof; and a plurality of doors, each of which is hinged along its tops edge to an aperture in said top cover so that each said door must be pushed inwardly to gain access to one of said compartments, each said door is in the shape of a trapezoid so that when opened will expose only one of said compartments; and e) means connected to the bottom wall of said housing, for rotating said housing latitudinally along its axis when placed upon a flat surface so that one portion of said access means will always face a person, allowing the person to deposit the trash items into one of the selective compartments.

2. An improved trash separator container as recited in claim 1, wherein said multiple compartment means includes a plurality of receptacles, each having an open top with each said receptacle sized to fit into said housing.

3. An improved trash separator container as recited in claim 2, wherein each said receptacle includes a pair of hand grips so that said receptacles can be installed and removed from said housing by the person.

4. An improved trash separator container as recited in claim 3, further includes:

a) said housing having a recess upwardly extending flange about the open top thereof; and b) said top cover having a downwardly extending lip about its perimeter so that said lip can fit over said flange of said housing.

5. An improved trash separator container as recited in claim 5, wherein each said door includes a spring a the hinge so that said door will normally be in a closed position.

6. An improved trash separator container as recited in claim 6, wherein said rotating means is a lazy susan configuration that includes:

a) a base member to sit upon the flat surface;

b) a stanchion extending upwardly form the center of said base member; and c) a plate rotatable upon said stanchion and affixed to the bottom wall of said housing.

7. An improved trash separator container as recited in claim 6, wherein said housing is in a four sided box-shaped configuration so that four receptacles can fit therein.

8. An improved trash separator container as recited in claim 7, wherein said top cover is in the shape of a four sided frustrum pyramid.

9. An improved trash separator container as recited in claim 8, wherein said base member is in the shape of an octagonal plinth.

10. An improved trash separator as recited in claim 6, wherein said housing is in a three sided triangular shaped configuration so that three receptacles can fit therein.

11. An improved trash separator as recited in claim 10, wherein said top cover is in the shape of a three sided frustrum pyramid.

12. An improved trash separator container as recited in claim 11, wherein each said door is in the shape of a frustrum triangle so that when opened will expose only one of said receptacles therein.

* * * * *